United States Patent [19]

Miller

[11] 4,172,300

[45] Oct. 30, 1979

[54] POUCH ZIPPER BLANKET AND METHODS OF CONSTRUCTING AND UTILIZING SAME

[76] Inventor: Dolores M. Miller, 2076 Seymour Lake Rd., Ortonville, Mich. 48462

[21] Appl. No.: 911,385

[22] Filed: Jun. 1, 1978

Related U.S. Application Data

[63] Continuation of Ser. No. 746,239, Dec. 1, 1976, abandoned.

[51] Int. Cl.[2] ..... A47G 9/00

[52] U.S. Cl. ..... 5/424; 2/69.5; 5/494

[58] Field of Search ..... 5/336, 320, 347; 2/69, 2/69.5; 128/134

[56] References Cited

U.S. PATENT DOCUMENTS

| | | | |
|---|---|---|---|
| 1,403,873 | 1/1922 | Scott | 5/336 |
| 1,584,853 | 5/1926 | Dern | 2/69 |
| 1,964,271 | 6/1934 | O'Dwyer | 2/69.5 |

*Primary Examiner*—Peter M. Caun

*Attorney, Agent, or Firm*—Irving M. Weiner; Pamela S. Burt; Melvin Yedlin

[57] ABSTRACT

A pouch zipper blanket for securely holding a baby therein. The pouch zipper blanket includes an outer blanket member which has the outward appearance of a conventional baby blanket but has provided on its inner face a zippered pouch portion which safely and securely holds a baby therein. After a baby is in position in the zippered pouch, the outer blanket member can then be wrapped around the baby in a conventional manner.

2 Claims, 6 Drawing Figures

POUCH ZIPPER BLANKET AND METHODS OF CONSTRUCTING AND UTILIZING SAME

This is a continuation of application Ser. No. 746,239, filed Dec. 1, 1976 now abandoned.

BACKGROUND OF THE INVENTION

1. Field of the Invention

The present invention relates generally to a baby blanket having secured thereto a zippered pouch portion for safely and effectively confining a baby therein.

More particularly, the invention provides a pouch zipper blanket with the pouch portion secured on the inner face of the blanket so that after a baby has been placed in the pouch the surrounding blanket portion can be wrapped around the baby in a conventional manner, giving the outward appearance of a conventional baby blanket.

2. Description of the Prior Art

Heretofore there has been developed a wide variety of baby covers for holding a baby therein. Such covers include items such as buntings, blankets, restrictive crib sheets, and an assortment of other conventional covers. Many of such covers, however, have attendant problems and disadvantages including ineffective confinement of the baby therein, or on the other hand, excessively restrictive confinement of the infant which may result in discomfort or danger to the infant.

There has developed a long-felt need for a baby cover which is versatile, safely holds the baby in a comfortably confined position, while at the same time provides an outwardly aesthetically pleasing appearance.

Illustrative of the prior art covers for babies are: U.S. Pat. No. 2,720,661 issued in 1955 to J. S. Harris entitled "COVER FOR BABY BEDS;" U.S. Pat. No. 2,722,694 issued in 1955 J. Bryant entitled "RESTRAINING BLANKET;" U.S. Pat. No. 3,121,885 issued in 1964 to V. C. Cherry entitled "RESTRAINING CRIB SHEET;" and U.S. Pat. No. 3,872,524 issued in 1975 to Hummel entitled "BABY COVER."

The aforementioned conventional baby covers, as well as the covers diclosed in the aforementioned patents, are deficient in that they are subject to the shortcomings and disadvantages referred to hereinabove, and thus have not been successful in providing a practical, versatile, and efficient baby cover.

The present invention overcomes the shortcomings and disadvantages referred to hereinabove, and at the same time provides a highly practical, safe, durable, and effective baby cover with a minimum of parts and a low cost of manufacture.

SUMMARY OF THE INVENTION

The present invention provides a baby cover which includes a first blanket-shaped member having an inner face and an outer face and a second substantially flat pouch member having a lower peripheral edge portion and an upper peripheral edge portion. The second member is obliquely disposed on the inner face of the first member and the lower peripheral edge portion of the second member is secured to the first member, thereby defining a pouch. The upper peripheral edge portion of the second member and the inner face of the first member define between them an opening for the pouch. A slit is provided in the second member, and extends from the upper peripheral edge portion of the second member into close proximity with the lower peripheral edge portion of the second member. The opening and the slit define a continuous aperture through which a baby may be passed, and the slit is provided with closure means, such as a zipper, for selectively opening and closing the slit.

It is an object of the invention to provide a baby cover which has a rectangular pouch member and a rectangular blanket member with the rectangular pouch member being disposed on the inner face of the blanket member symmetric to a diagonal line of the blanket member so that when the baby is placed in the pouch member the blanket portion can be wrapped around the baby in a conventional manner.

Other objects and details of the invention will become apparent from the following description, when read in conjunction with the accompanying drawings.

DETAILED DESCRIPTION OF SOME PREFERRED EMBODIMENTS OF THE INVENTION

Figure 1:
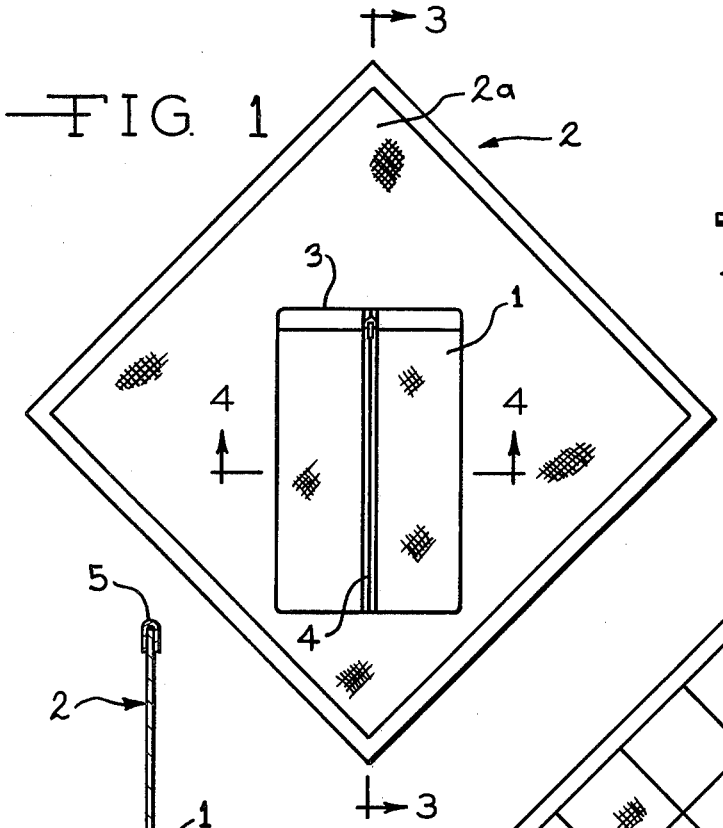
FIG. 1 illustrates an elevational view of the inner face of the baby cover having the pouch member secured thereon.

With reference to FIG. 1, there is depicted a folded-out view of the inner face 2*a* of the baby cover showing the pouch member 1 disposed thereon. The baby cover includes a blanket member 2, and as depicted the pouch member 1 is disposed on the inner face 2*a* thereof symmetric to a diagonal line of the blanket member 2. The desirability of such disposition of the pouch member 1 will be discussed hereinbelow more thoroughly with respect to FIG. 5.

The pouch member 1 is secured to the blanket member 2 most desirably by means of sewn stitches. The pouch member 1 is stitched to the blanket member 2 on each of its peripheral edges with the exception of the top peripheral edge 3. In this manner, an opening for the pouch is defined between the top peripheral edge 3 and the inner face 2*a* of the blanket member 2. The pouch member 1 is provided with a full length slit having a zipper 4 disposed thereon to selectively open and close the slit. Optionally, the zipper tab of the zipper 4 can be provided with a decorative knit or fluff ball. It should be noted that although a zipper is most desirable for closing the slit, any suitable type of fastening means, such as buttons, snaps, Velcro fasteners, etc., can be employed to selectively open and close the slit.

A hem portion 5 extends continuously around the peripheral edge of the blanket member 2, and it is contemplated that the hem portion 5 can be fabricated of any conventional blanket hem fabric, such as satin or satin-like fabric.

The blanket member 2 is of conventional infant blanket dimensions, such as, for example, approximately 36"×43", with a 2" hem dimension, however the dimensions of the blanket member 1 can be varied to accommodate various size infants. The pouch member 1 is considerably smaller in dimension than the blanket member 2, such as, for example, if the blanket member 2 were to be approximately 36"×43", the pouch member 1 would desirably be approximately 20"×20". Here again the dimensions of the pouch member 1 are also variable, depending upon the size and/or age of the infant to be accommodated therein.

The inner face 2a of the blanket member 2 is preferably fabricated of a very plush material which would be highly comfortable and pleasing to a baby. Preferred types of material to be used for the inner face 2a would include, for example, flanelette, fleecy material, fur-like material, etc. The same types of plush material are desirably used for fabricating the pouch member 1 so that the baby being held will be exposed to a pleasing sensation when his skin contacts the interior of the baby cover.

Figure 2:
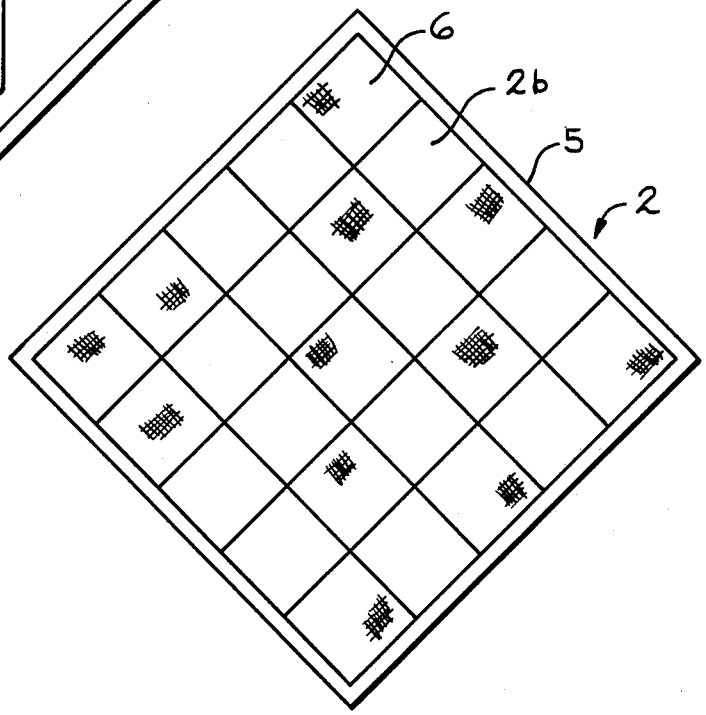
FIG. 2 depicts an elevational view of the outer face of the baby blanket in accordance with the invention.

Referring now to FIG. 2, the outer face 2b of the blanket member 2 is shown in detail. The outer face 2b is comprised of a series of rectangular fabric patches 6 which are stitched together in a quilt fashion, with the hem portion 5 extending continuously around the peripheral edge thereof. To enhance the aesthetic quality of the outer face 2b of the blanket member 2, the fabric patches 6 which form the quilt-like outer face 2b can be brightly colored. In this connection, for example, if the infant to be held in the baby cover is female, the outer face 2b can be constructed of pink colored patches 6, while in the alternative blue colored patches would be desirable for a male infant.

It should be noted that although the FIG. 2 embodiment illustrates a quilt-like outer face 2b of the blanket member 2, a single continuous fabric piece can be substituted for the patches 6 if desired. In any event, the fabric used in fabricating the outer face 2b of the blanket member 2 is desirably quite durable, stain-resistant, and if desired, moisture resistant. Preferred fabrics for use in constructing the outer face 2b would include, for example, polyester double-knits, nylons, rayons, or combinations thereof. In any event, it is highly desirable that the combinations of fabrics used in fabricating the pouch member 1, the inner face 2a and the outer face 2b be machine-washable material.

Figure 3:
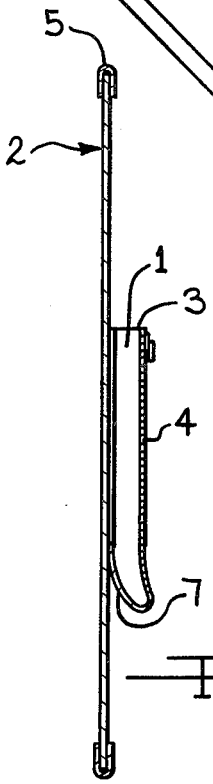
FIG. 3 shows a view of the baby cover taken along line 3—3 in FIG. 1.

FIG. 3 illustrates in greater detail the positioning of the pouch member 1 on the blanket member 2. As can be seen, the pouch member 1 is constructed of a continuous fabric piece which is secured on all edges except the top edge to the blanket member 2. A fold portion 7 is formed by folding the lower peripheral side of the pouch member 1 under and upwardly towards the top edge 3 and then stitching same to the blanket member 2. In this manner, the fold portion 7 is free to extend outwardly from the plane of the blanket member 2, thus providing expansion ability for the pouch member 1 when an infant is placed therein. As depicted, the zipper 4 extends from the top peripheral edge 3 of the pouch member 1 into close proximity with the lower edge of the pouch member 1.

Figure 4:
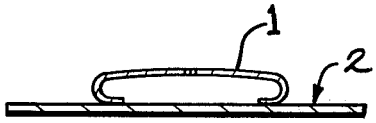
FIG. 4 illustrates a view of the baby cover taken along line 4—4 of FIG. 1.

Referring now to FIG. 4, it can be seen that both side edges of the pouch member 1 are provided with an extra overlap of fabric extending beyond the stitch lines which secure the sides of the pouch member 2 to the blanket member 1. Hereagain, the pouch member 1 is thus provided with an ability to expand to accommodate an infant being placed therein. To provide even greater expansion properties of the pouch member 2, if desired, gathered portions of the material used to fabricate the pouch member 1 can be sewn into the peripheral stitch lines thereof.

In the manner as above described, the pouch member 1 will lie substantially flat against the inner face 2a of the blanket member 2 until an infant is positioned in the pouch member 1. At that point, the aforedescribed extensible characteristics of the pouch member 1 will provide extension thereof to accommodate the infant.

Figure 5:
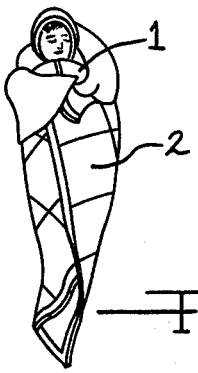
FIG. 5 depicts the baby cover in accordance with the invention having an infant placed therein and the blanket portion wrapped around the infant.

With reference now to FIG. 5, the baby cover is shown in use having a baby placed therein. In order to arrive at the configuration shown in FIG. 5, the following steps are followed. First, the baby cover is laid open as depicted in FIG. 1. The zipper 4 is then opened, and the top opening as well as the slit of the pouch member 1 work together to yield a fairly large open aperture for placing the baby therethough. The baby is then easily positioned within the pouch member 1, and the zipper 4 is closed. At this stage, the baby is confined quite effectively and safely within the pouch member 1, and thus it is an easy matter to then wrap the blanket portion 2 around the baby in a conventional manner. Not only will the infant be safely confined during the blanket wrapping operation, but any transportation of the baby within the cover will be facilitated because the confinement afforded by the pouch member 1 will prevent the baby's kicking or struggling from upsetting the wrapped blanket member 2.

Figure 6:
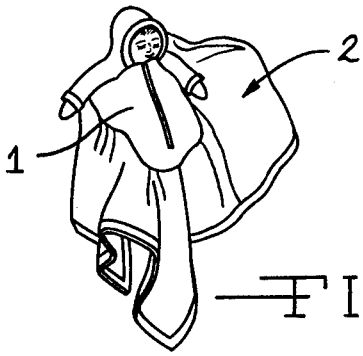
FIG. 6 shows the baby cover in accordance with the invention having an infant placed therein.

FIG. 6 illustrates the relative positioning of the infant within the confines of the pouch member 1. It should be noted that the infant's arms can be left free to extend from the pouch member 1 as depicted in FIG. 6, or in the alternative the baby's arms can be positioned within the pouch member 1, whichever position is preferred. In addition, if desired, the infant can be placed in the pouch member 1 and the blanket member 2 can be left open for a cloak effect. Alternatively, any desired placement or wrapping modification of the disposition of the blanket member 2 with respect to the pouch member 1 can be employed, thus providing great diversity in the use and function of the baby cover.

It should be noted that due to the fact that the infant is safely and securely confined within the pouch member 1, the baby cover is quite effective in protecting the infant from cold or harsh weather conditions, and at the same time the cover can be used to place the infant in for sleeping. In the event that the infant is to be taken out into extremely harsh weather conditions, it is desirable that the entire baby cover, or at least a portion thereof, be provided with an insulating liner which can be fabricated from any type of thermal insulating fabric.

It can thus be seen that the baby cover as described is highly simple in construction, and at the same time provide a safe and efficient cover for holding a baby. In addition, the cover can be varied in its dimensions to accommodate infants of varying sizes and/or ages.

The present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

I claim:

1. A pouch blanket comprising:

a main blanket member having a substantially rectangular shape and including an inner surface and an outer surface;

a pouch member permanently connected to said inner surface of said blanket member, said pouch member being substantially rectangular in shape and including a top end, a bottom end, and side peripheral edges;

said pouch member having a permanent opening at its top end and a free fold portion adjacent its bottom end;

said free fold bottom end portion comprising a folded-under portion extending upwardly towards said top end with the edge thereof stitched along its length to said main blanket member, said free fold portion being free to extend outwardly from the plane of said main blanket member to provide an expansion ability for said pouch member when an infant is placed therein;

said free fold portion being stitched to said main blanket member at a predetermined distance above the lowermost end of said pouch member;

said permanent opening of said pouch member extending across the entire width of said pouch member adjacent said top end;

a full-length slit being provided in said pouch member and being disposed substantially perpendicular to said top and bottom ends of said pouch member;

closure means provided at said slit for selectively and adjustably opening and closing said slit;

said pouch member being permanently connected on said inner surface of said main blanket member substantially symmetrical to a diagonal line of said main blanket member so as to define a pouch between said main blanket member and said pouch member;

said side peripheral edges of said pouch member being folded under and permanently connected along the length thereof to said inner surface of said main blanket member to form side overlap portions of said pouch;

said side overlap portions extending outwardly from said inner surface of said main blanket member to permit expansion of said pouch when an infant is placed therein;

said slit being provided along the central longitudinal axis of said pouch member and substantially along said diagonal line of said main blanket member; and said permanent opening of said pouch member and said slit defining a continuous aperture through which an infant may be passed.

2. A pouch blanket according to claim 1, wherein:

said closure means for said slit comprises a zipper, and said zipper extends substantially along the length of said slit.

* * * * *